US008997624B1

(12) United States Patent
Jansen et al.

(10) Patent No.: US 8,997,624 B1
(45) Date of Patent: Apr. 7, 2015

(54) JET PIPE SERVO WITH FLEXURE PIVOT

(75) Inventors: Harvey B. Jansen, Mesa, AZ (US); Jerame J. Powell, Phoenix, AZ (US)

(73) Assignee: Jansen's Aircraft Systems Controls, Inc., Tempe, AZ (US)

( * ) Notice: Subject to any disclaimer, the term of this patent is extended or adjusted under 35 U.S.C. 154(b) by 1041 days.

(21) Appl. No.: 13/078,457

(22) Filed: Apr. 1, 2011

Related U.S. Application Data

(60) Provisional application No. 61/320,543, filed on Apr. 2, 2010.

(51) Int. Cl.

| | |
|---|---|
| ***F15B 9/07*** | (2006.01) |
| ***F15B 9/06*** | (2006.01) |
| *F15B 13/043* | (2006.01) |
| *F15C 3/10* | (2006.01) |
| *F15C 3/12* | (2006.01) |

(52) U.S. Cl.
CPC ... *F15B 9/07* (2013.01); *F15B 9/06* (2013.01); *F15B 13/0436* (2013.01); *F15C 3/10* (2013.01); *F15C 3/12* (2013.01)

(58) Field of Classification Search
CPC ..... F15B 9/07; F15B 9/06; F15B 13/0436; F15C 3/10; F15C 3/12
USPC ..... 91/3; 137/83
See application file for complete search history.

(56) References Cited

U.S. PATENT DOCUMENTS

| | | | | |
|---|---|---|---|---|
| 2,696,804 | A * | 12/1954 | Kendall, Jr. | 91/3 |
| 2,699,356 | A * | 1/1955 | Ziebolz | 137/83 |
| 2,724,397 | A * | 11/1955 | Ziebolz | 137/83 |
| 2,814,183 | A * | 11/1957 | Holzbock | 91/3 |
| 3,137,309 | A * | 6/1964 | Blase et al. | 137/83 |
| 3,205,782 | A * | 9/1965 | Tourtellotte | 91/3 |
| 3,217,728 | A * | 11/1965 | Pegram | 137/83 |
| 3,221,760 | A | 12/1965 | Buchanan | |
| 3,338,136 | A * | 8/1967 | Jerome et al. | 91/3 |
| 3,584,649 | A | 6/1971 | Cobb | |
| 3,621,880 | A | 11/1971 | Jessee et al. | |
| 3,678,951 | A | 7/1972 | Coakley | |
| 6,786,236 | B2 | 9/2004 | Jansen | |
| 6,918,569 | B2 | 7/2005 | Jansen | |
| 7,004,449 | B2 | 2/2006 | Jansen | |
| 7,137,613 | B2 | 11/2006 | Jansen | |

* cited by examiner

*Primary Examiner* — Edward Look
*Assistant Examiner* — Michael Quandt
(74) *Attorney, Agent, or Firm* — Quarles & Brady LLP

(57) ABSTRACT

A servomechanism has a jet pipe mounted by a flexure pivot driven by an electromagnet to control the position of the jet pipe. A fixed seal tube surrounds the armature and keeps the coil isolated and dry. The flexure pivot has two parts that can move with respect to one another. The jet pipe can be fixed with respect to one part and movable with respect to the other such that when the electromagnet armature moves pivotal motion is imparted to the jet pipe. A multi-port jet receiver receives media from the jet pipe in different orifices dependent upon armature position. That in turn can extend or retract an actuator, such as a piston, depending upon which receiver orifice receives greater pressure. A feedback mechanism can link the actuator to the jet pipe to provide feedback input used to improve the accuracy of the device.

18 Claims, 11 Drawing Sheets

JET PIPE SERVO WITH FLEXURE PIVOT

CROSS-REFERENCE TO RELATED APPLICATION(S)

This application claims benefit to U.S. provisional application Ser. No. 61/320,543, filed Apr. 2, 2010.

STATEMENT OF FEDERALLY SPONSORED RESEARCH OR DEVELOPMENT

Not applicable.

BACKGROUND

1. Technical Field

The present disclosure relates to servomechanisms, and in particular, to servomechanisms having jet pipes.

2. Discussion of the Art

Servomechanisms, such as servo-valves and rotary and linear servo-actuators, are well-known for use in applications requiring a high degree of position accuracy. Servos generally incorporate feedback systems. For example, closed-loop, negative feedback systems compare the control input to the actual position at the output of the device. Error signals relaying differences between the actual and desired values are used to drive the servo to reduce or eliminate the error and operate accurately. Servos can generate mechanical output through various means, including electric, electromagnetic, hydraulic and pneumatic input and combinations thereof, in which a first input (e.g., an electromagnetic force) can be force amplified using a second input (e.g., hydraulic pressure). Furthermore, servos can be direct drive devices, see e.g., U.S. Pat. No. 3,678,951, or multi-stage devices in which the input force of the preceding stage is amplified by a subsequent stage.

An example of the a multi-stage servo-actuator is disclosed in U.S. Pat. No. 3,221,760, which describes an electro-hydraulic servo having an electromagnetically driven flapper first stage and a pilot spool second stage. A mechanical force feedback device, such a feedback spring, links the first and second stages, specifically the spool to the flapper. Energizing the electromagnet causes the armature to pivot the flapper to close off one nozzle orifice more than the other, which creates a pressure differential across the spool so that it changes position. Movement of the spool causes a pressure difference across the outlet flow paths to drive the actuator device, here a piston-cylinder arrangement. Movement of the spool also imparts a returning force to the flapper through the feedback device.

While such servos can be of various constructions, flapper-type, jet pipe-type, and combinations thereof, are common. Generally, flapper-type servos use a flexible or movable flapper member to restrict flow through one of two nozzle orifices communicating with an associated output pressure port, such as disclosed in the aforementioned U.S. Pat. No. 3,221,760. Jet pipe-type servos feed the amplifying media through a nozzled tube or jet pipe that is movable to direct the media to one of two receiver orifices communicating with an associated output pressure port, see e.g. U.S. Pat. No. 3,678,951. Combinations of the two can have the jet pipe mounted to a flapper, see e.g., U.S. Pat. Nos. 3,584,649 and 3,621,880.

Jet pipe-type configurations are generally preferred over flapper-type configurations in contaminated environment applications, such as jet engine applications in the aircraft industry. Servos with jet pipes are generally less sensitive to contamination due to the permissibility of larger nozzle orifices and their better ability to maintain operation, even if sluggish, with a clogged orifice.

In addition to the issue of contamination, it is typically desired to isolate the electromagnetic coil(s) from the hydraulic fluid. Early jet-pipe servos were constructed so that the armature and the feed tube providing hydraulic fluid to the jet pipe were an integral unit or were an extension of one another such that there was no separation between the driven and driving members. The aforementioned U.S. Pat. Nos. 3,221,760 and 3,678,951 are exemplary of the construction of conventional dry coil servo valves, which use a thin-walled, flexible seal tube disposed between the housing and the flapper or jet pipe to isolate the coils from the fluid while permitting movement of the flapper or jet pipe without causing excessive (for some applications) coulomb friction hysteresis. The use of the flexible seal tube is more complex to manufacture, and in applications where higher hysteresis is acceptable it may be replaced by an elastomeric O-ring. However, O-rings are generally unacceptable for applications with large variations in fluid and ambient temperatures and/or where the fluid can cause excessive swelling of the elastomeric material. Yet, neither may be acceptable for applications where near-zero hysteresis is required, reliability is critical, and induced vibration can cause erratic performance of the servo.

BRIEF SUMMARY

The disclosure relates to a jet pipe servo device in which the jet pipe is mounted by a flexure pivot. The jet pipe is mounted in the flexure pivot so that it is fixed with respect to one part and movable with respect to the other such that when force is applied to the jet pipe it can be pivoted to direct output media as needed.

Specifically, in one aspect the disclosure pertains to a jet pipe servo device that can have an electromagnet assembly including a coil and an armature. A flexure pivot can have a first part fixed with respect to the coil and second part linked to the armature and movable therewith with respect to the first part. A jet pipe can be linked to the second part of the flexure pivot. A jet receiver can have first and second orifices. The first orifice can receive media from the jet pipe when the armature is in a first position, and the second orifice can receive media from the jet pipe when the armature is in a second position.

In another aspect the disclosure pertains to a jet pipe servo-actuator having a servo-valve and actuator. The single or multi-stage servo-valve can include an electromagnet, a flexure pivot having first and second parts movable with respect to one another, a jet pipe fixed with respect to the second part of the flexure pivot and movable with respect to the first part of the flexure pivot, and a jet receiver having first and second orifices. The first orifice can receive media from the jet pipe when the armature is in a first position, and the second orifice receiving media from the jet pipe when the armature is in a second position. The actuator can include a cylinder and a piston arrangement. Media from the jet pipe can be directed to pass through the first orifice and an associated cylinder port to actuate the piston and through the second orifice and another cylinder port to retract the piston.

In various other aspects, a seal tube can be disposed between the movable armature and the coil to isolate and keep dry the coil without contacting any of the movable components of the device. Moreover, the jet pipe can be mounted so that each end is movable. One end of the jet pipe can be fixed either to the armature of the electromagnet or to the second part of the flexure pivot, which is in turn fixed to the armature, or to both the armature and the second part of the flexure pivot.

Also, the first part of the flexure pivot can include an opening through which the jet pipe extends, and the second part of the flexure pivot can include an opening aligned with the opening in the first part through which the jet pipe extends. The jet pipe can be aligned along an axis of the armature. Furthermore, the first and second parts of the flexure pivot can be joined by one or more struts defining a passageway for communicating media passing through the first and second parts of the flexure pivot to a passageway of the jet pipe. For example, there can be two struts each defining such a passageway. further including an actuator assembly.

The feedback assembly can including a spring that is linked to the jet pipe.

These and still other advantages will be apparent from the following detailed description of the drawings. To assess the full scope of the invention the claims should be looked to as the construction(s) shown in the drawings and described below are not limiting.

DETAILED DESCRIPTION OF THE DRAWINGS

Figure 1:
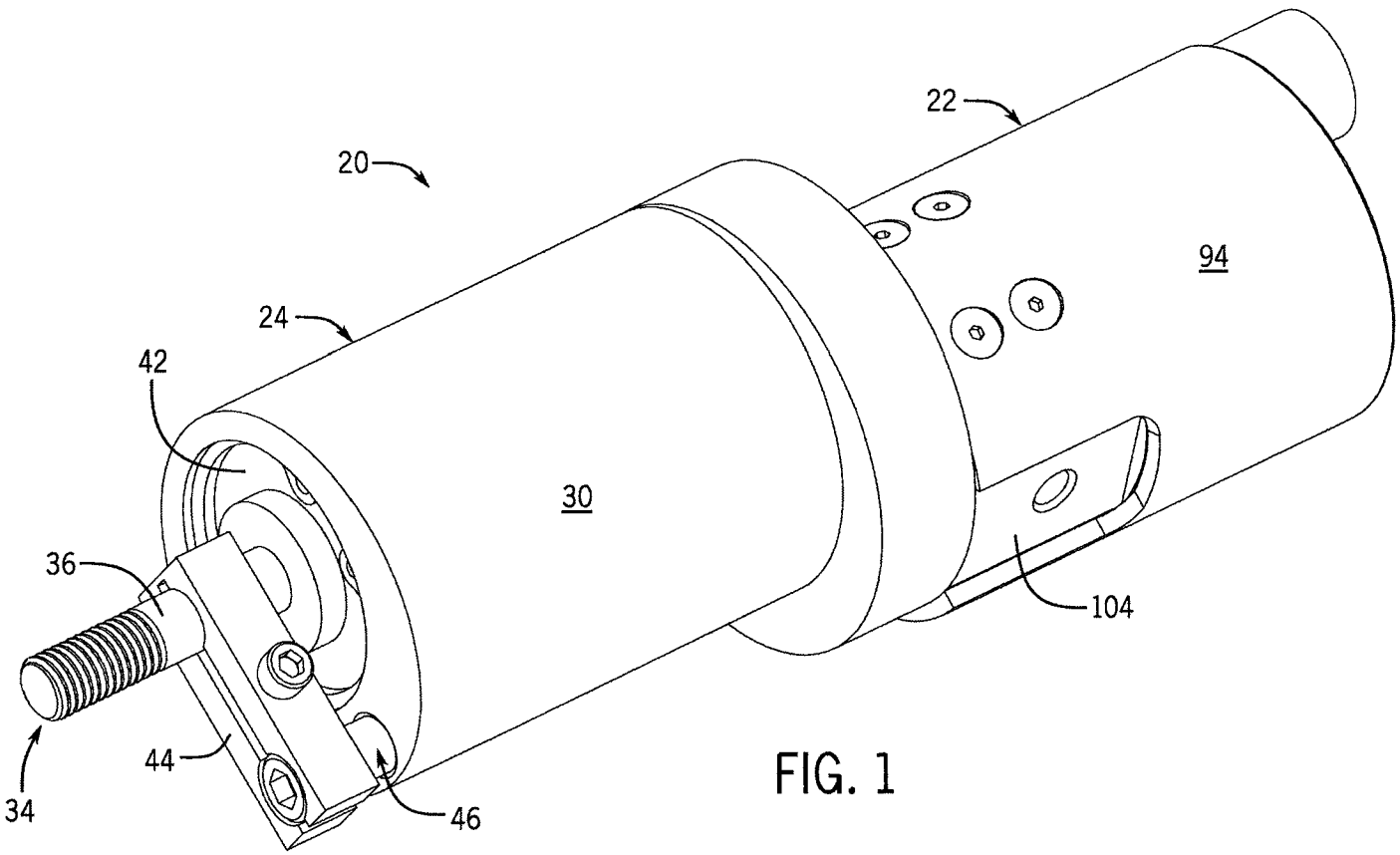
FIG. 1 is a isometric view of a jet pipe servo-actuator according to the present disclosure.
Figure 15:
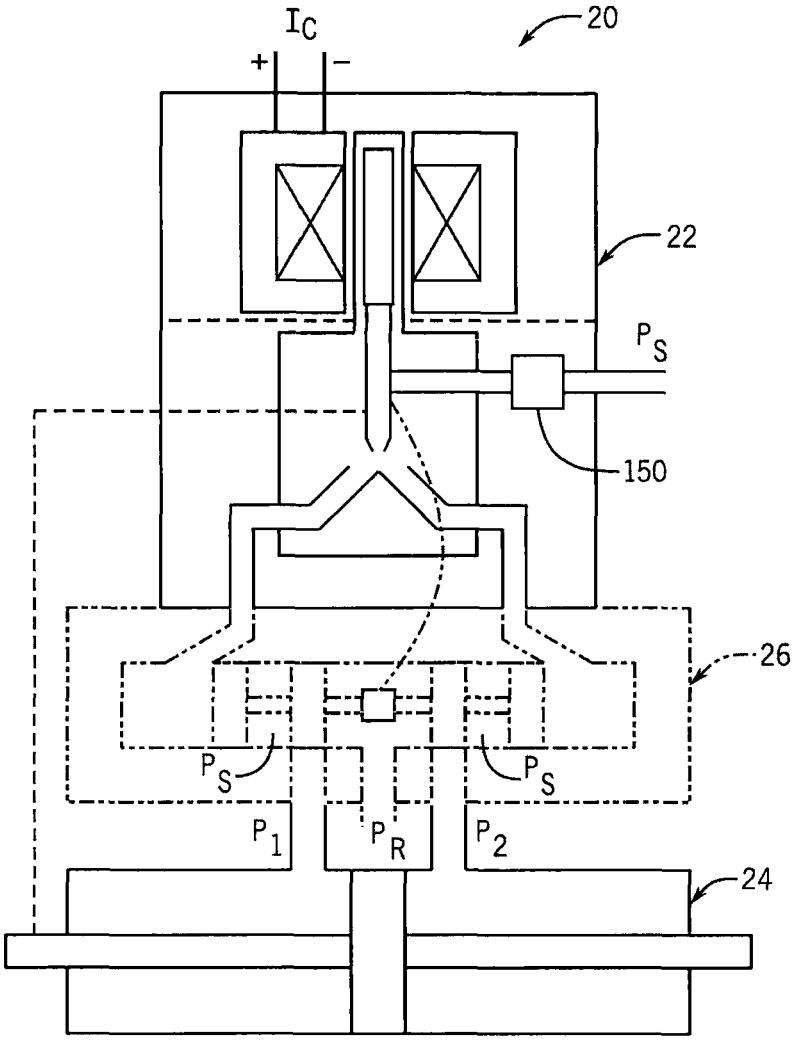
FIG. 15 is a schematic representation of the servo-actuator of FIG. 1, shown with an optional additional pilot spool stage of the servo-valve.

The following is a description of an exemplary construction of a servomechanism according to the present disclosure. The exemplary servomechanism is in the form of a servo-actuator 20 as shown in the drawings. As shown in FIG. 1, the servo-actuator 20 includes a servo-valve 22 that drives an actuator 24. Before describing the details of the exemplary construction, several points are noted. First, the following will discuss the exemplary construction with the working media being hydraulic fluid. However, the exemplary construction is capable for using air or other gases as the working media. Second, while the actuator 24 depicted in the drawings is a piston and cylinder arrangement, the servo-valve 22 can be used to drive any suitable actuator providing linear or rotary motion. Third, the servo-valve 22 depicted in the drawings is of single-stage construction, and directly drives the actuator 24. However, one or more optional additional stages may also be included. FIG. 15 illustrates the servo-actuator 20 schematically with an optional second stage 26, which is shown therein in dotted lines. The optional second stage 26 can be of any suitable construction, but is depicted as including a pilot spool 28 that moves in response to the working media and works to amplify the output force as is understood in the art. U.S. Pat. Nos. 3,221,760 and 3,584,649 disclose exemplary multi-stage servomechanisms with pilot spools of this type, the disclosure of which is hereby incorporated by reference as though fully described herein. Lastly, the exemplary construction of the servo-actuator 20 is suitable for use in high temperature, high vibration, contaminated environments, such as the recirculating hydraulic systems associated with air craft, and in particular jet engine, applications. However, the servo-actuator 20, or the servo-valve 22 component separately, can be used for other applications, such as robotics and animatronics. Therefore, this disclosure is not limited to the foregoing exemplary construction or any particular application of use.

Figure 2:
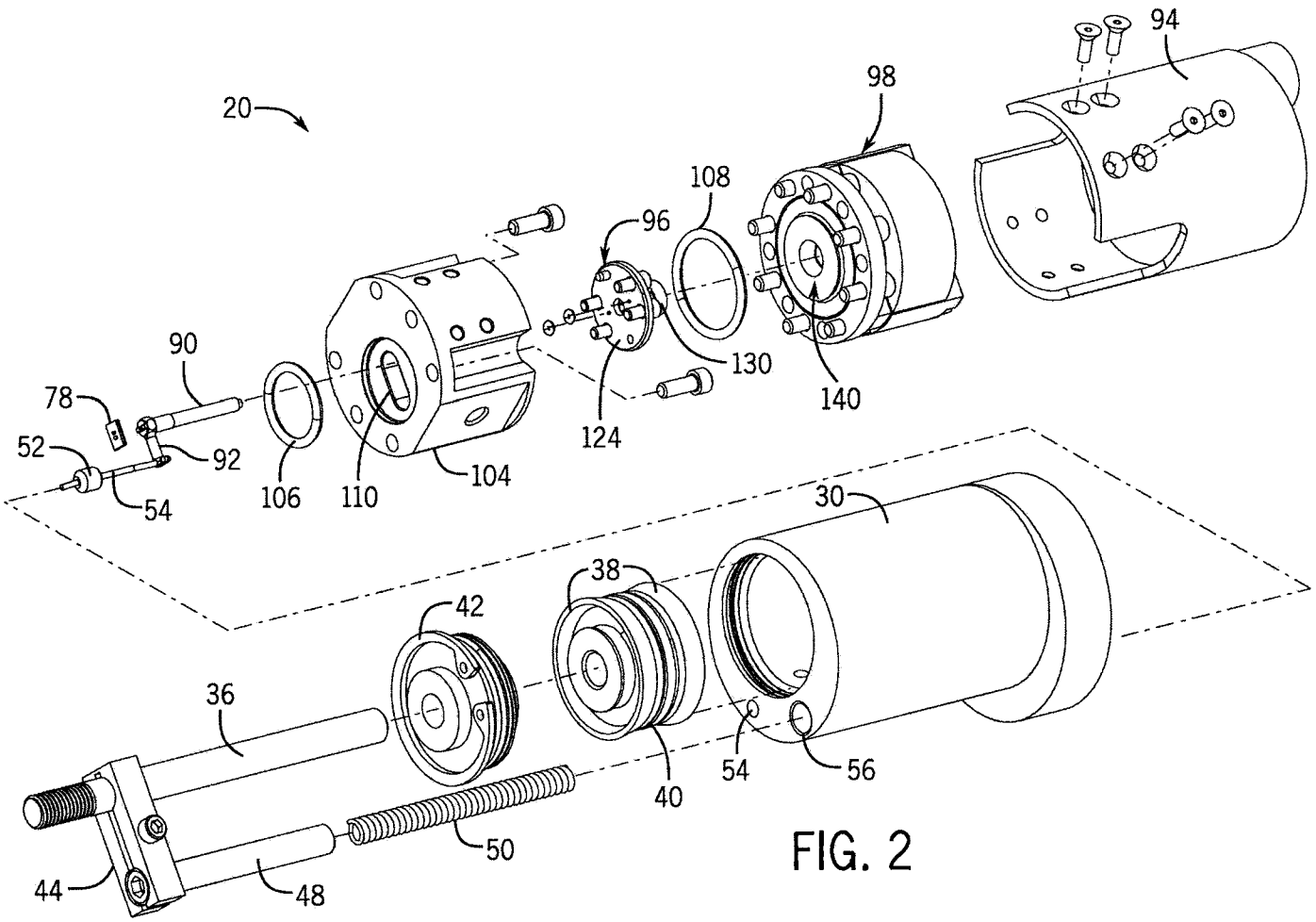
FIG. 2 is an exploded assembly view thereof.
Figure 3:
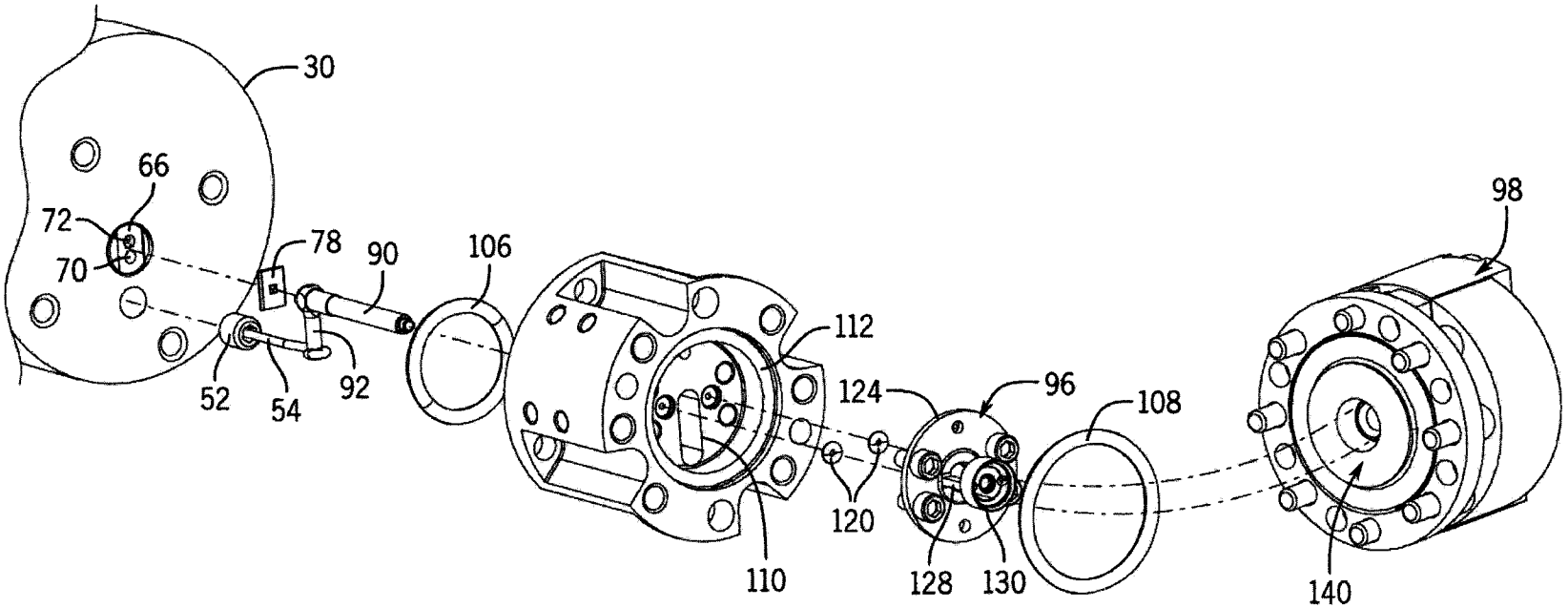
FIG. 3 is a reverse exploded assembly view of the servo-valve components thereof.
Figure 4:
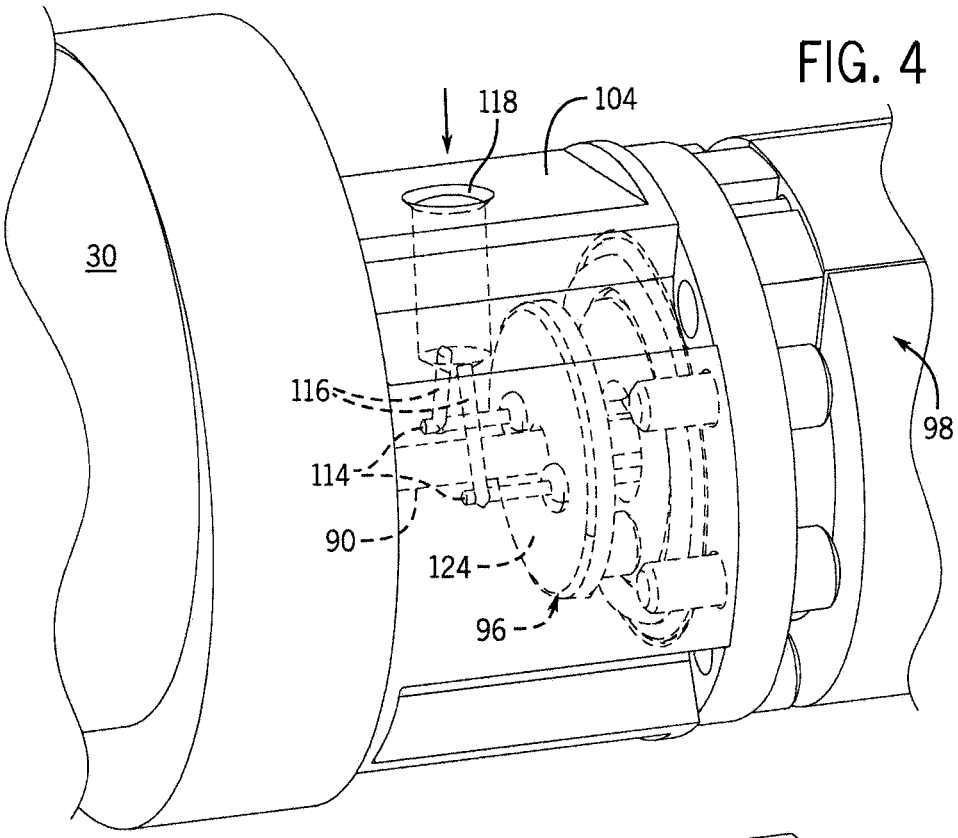
FIG. 4 is a partial isometric view of thereof.
Figure 10:
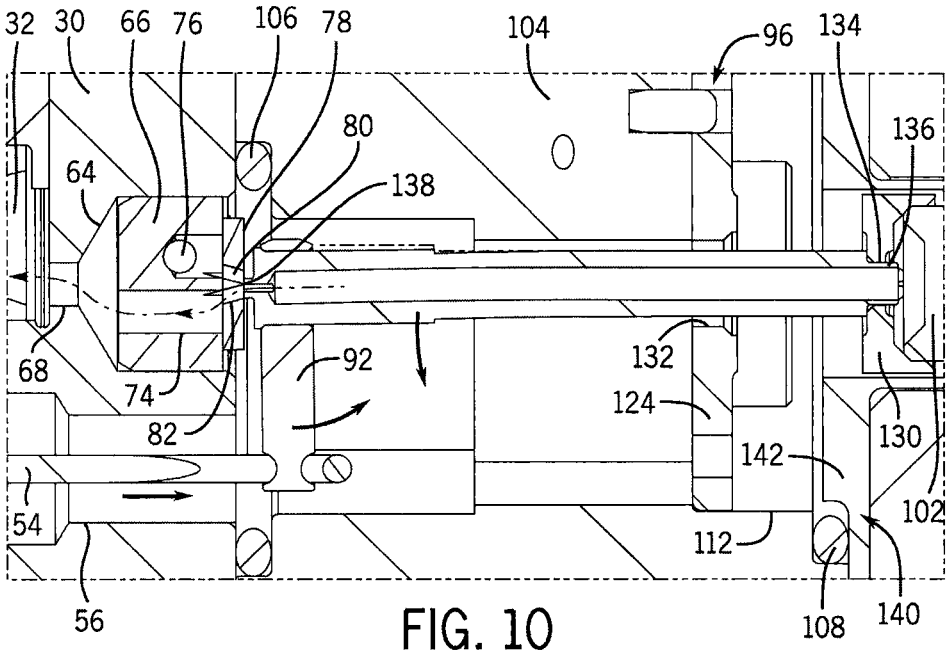
FIG. 10 is a partial enlarged view taken along line 10-10 of FIG. 7 showing the flow path from the jet pipe when extending the actuator.
Figure 14:
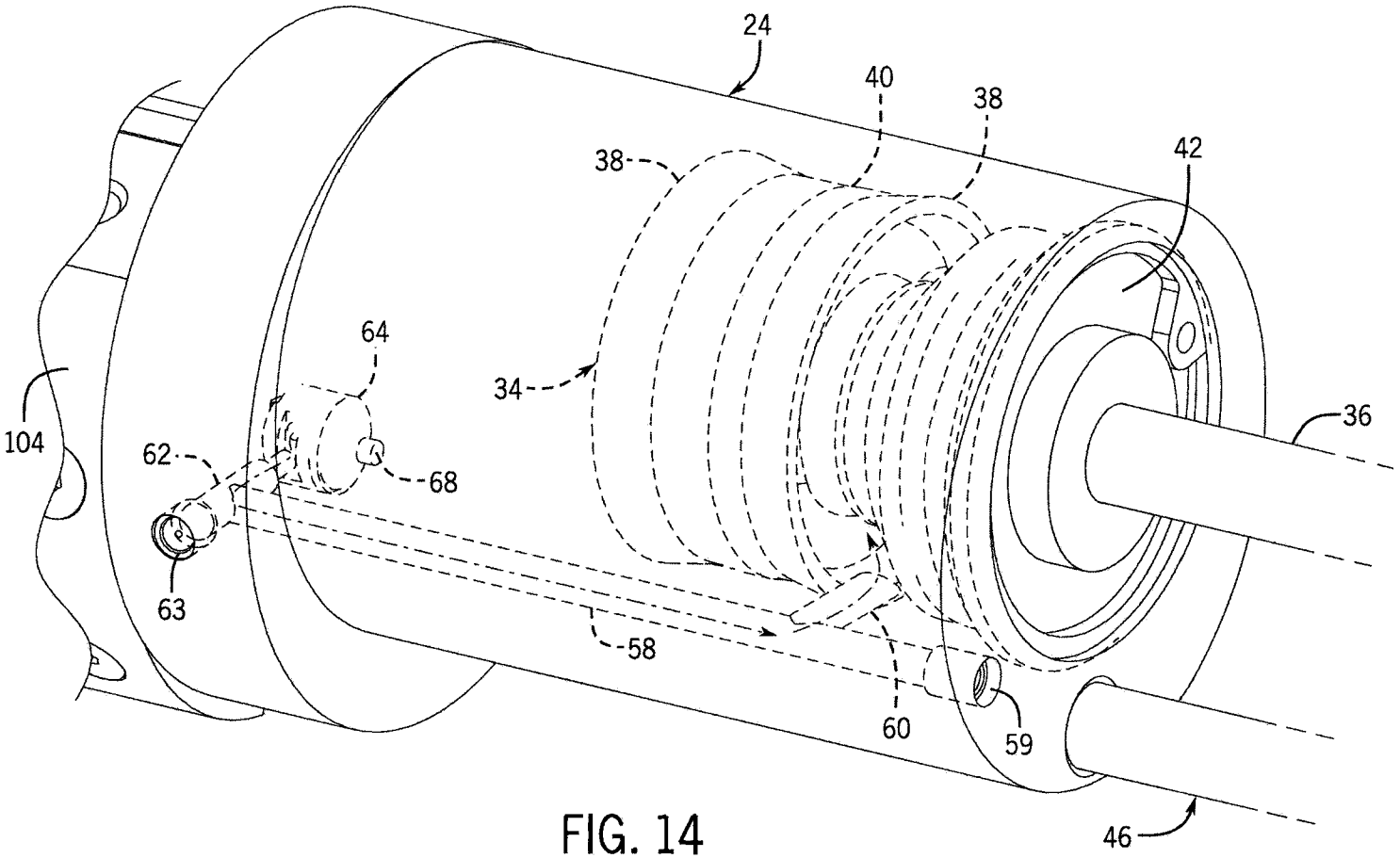
FIG. 14 is a partial enlarged isometric view showing internal features of the actuator.

Turning now to the exemplary construction of the servo-actuator 20. FIGS. 1-3 illustrate the main components of the servo-valve 22 and the actuator 24 of the servo-actuator 20. In particular, the actuator 24 includes a housing 30 that defines a cylinder bore 32 in which rides a piston 34 having a rod 36 and a head formed of two seals 38 fit onto an annular retainer flange 40 mounted to the rod 36. The free end of the rod 36 protrudes beyond the actuator housing 30 through an end cap 42 which closes off the cylinder bore 32 and creates a sliding seal with the rod 36. The free end of the rod 36 can be threaded or have other suitable connections for connecting to the component (not shown) driven by the servo-actuator 20. A rod clamp 44 is connected to the free end of the rod 36 to attach a feedback device 46, which can include a post 48, a coil spring 50, spring retainer 52 and pin hook 54. The feedback device 46 fits into a passage 56 running the length of a thicker wall of the actuator housing 30 parallel to the cylinder bore 32 so that it can be mechanically linked to the servo-valve 22, as described below. As shown in FIG. 14, a smaller passage 58 runs from a plugged port 59 and through the thicker wall of the actuator housing 30 parallel to passage 56. Near the end of passage 58 associated with the free end of the rod 36, a short radial passage 60 intersects the passage 58 and opens to the cylinder bore 32 to create a first cylinder pressure port. Another short radial passage 62 intersects the passage 58 near its opposite end and extends from another plugged port 63 to a cavity 64 housing a receiver 66. A short axial passage 68 extends from the bottom of the cavity 64 to the cylinder bore 32, as shown in FIGS. 10 and 14, to create a second cylinder port. As shown in FIGS. 3 and 10-13, the receiver 66 has two orifices 70 and 72. Orifice 70 communicates with the cylinder bore 32 through axial receiver passage 74 and the axial passage 68 of the actuator housing 30. Orifice 72 communicates with the cylinder bore through radial receiver passage 76 and radial passage 62 (and passage 58). A small splitter 78 adjacent to the receiver 66 has its angled offices 80 and 82 are in registration with respective orifices 70 and 72 of the receiver 66.

Turning now to the details of the components making up the servo-valve 22 of the exemplary servo-actuator 20. With reference to FIGS. 1-3, the receiver 66 receives working media from a jet pipe 90, which is linked to the feedback device 46 by engagement of the pin hook 54 with a radial flange 92 coupled to the jet pipe 90. The jet pipe 90 is movably mounted within a valve housing 94 via a flexure pivot 96, described in detail below. The valve housing 94 has a dry compartment for electrical input connections (not shown) and an electromagnet 98 having one or more coils 100 and a movable armature 102. The valve housing 94 also defines an open cavity in which a port block 104 is housed through which the working media flows. The port block 104 bolts to the flanged end of the actuator housing 30 and the valve housing 94 bolts to the port block 104 with O-rings 106 and 108 sealing the port block 104 with the actuator housing 30 and the electromagnet 98, respectively.

Figure 5:
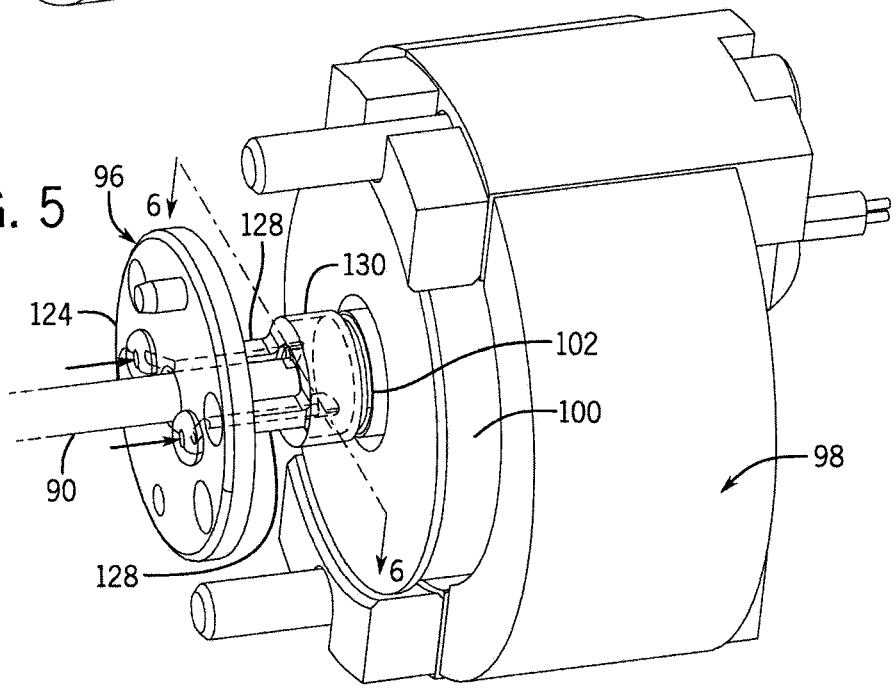
FIG. 5 is yet another partial isometric view thereof.
Figure 6:
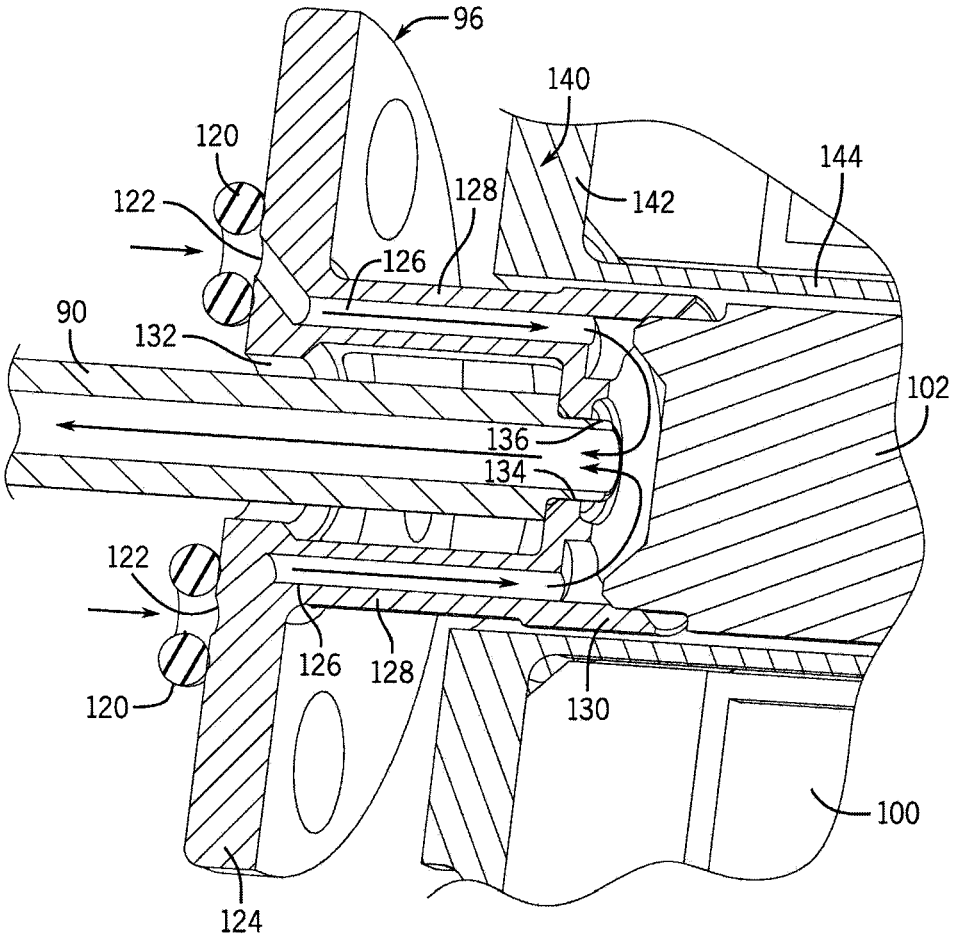
FIG. 6 is a partial sectional view thereof taken along line 6-6 of FIG. 5 through the jet pipe, flexure pivot and armature components.
Figure 7:
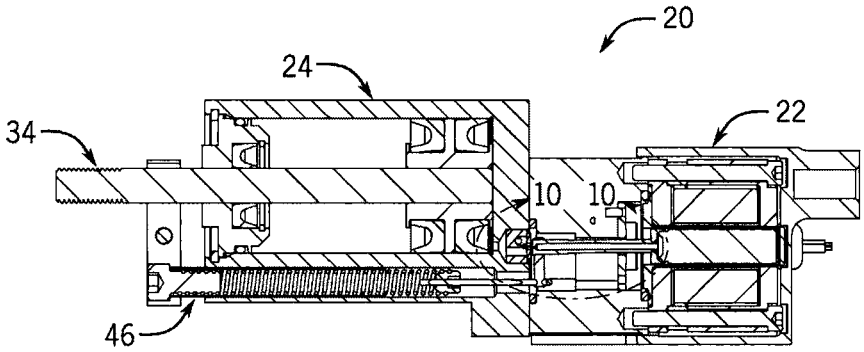
FIG. 7 is a sectional view taken along line 7-7 of FIG. 1, showing the servo-actuator in a retracted position.
Figure 8:
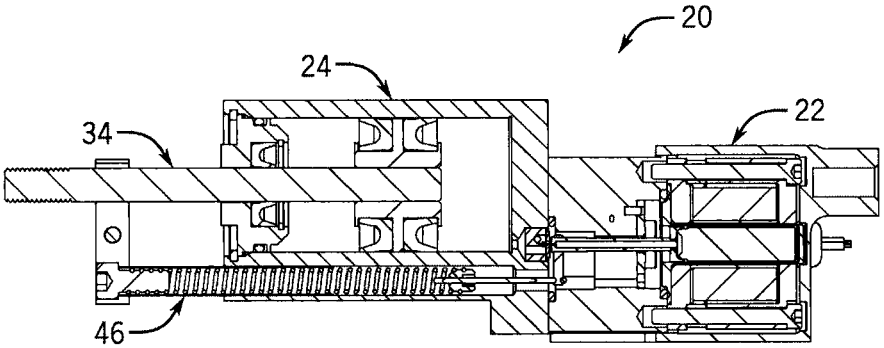
FIG. 8 is a sectional view similar to FIG. 7, showing the servo-actuator in an intermediate position.

As shown in FIGS. 2-4 and 10-11, the port block 104 has an oblong slot 110 extending axially through its length through which the jet pipe 90 extends and pivots. The oblong slot 110 terminates at a recessed cavity 112 in the side face of the port block 104 near the electromagnet 98 (see FIG. 3). At opposite sides of the oblong slot 110 are two axial passages 114 that also terminate at the recessed cavity 112. These axial passages 114 communicate (through radial passages 116) with the fluid inlet port 118 (see FIG. 4) to which a hydraulic fluid line (not shown) can be attached via proper fittings. The terminal ends of the axial passages 114 are recessed to hold O-rings 120 that seal against the flexure pivot 96 about openings 122 in a disc-shaped part 124 of the flexure pivot 96. As shown in FIGS. 5 and 6, the openings 122 lead to passages 126 that angle through the disc part 124 and then pass straight through two struts 128 which connect the disc part 124 to a collar part 130 of the flexure pivot 96. The struts 128 are spaced about openings 132 and 134 in the respective parts 124 and 130 through which the jet pipe 90 fits. Importantly, as shown in FIGS. 6 and 10, there is clearance between the jet pipe 90 and opening 132 in the disc part 124, but a reduced diameter end 136 of the jet pipe 90 is rigidly connected to the collar part 130 at the opening 134 in a lead proof manner. It should be noted that the jet pipe 90 could be mounted directly to the armature 102, rather than linked thereto by connection of the collar part 130. Further, as is known, the jet pipe 90 is tubular with open ends including a nozzle 138 at its free end (see FIG. 10).

Figure 11:
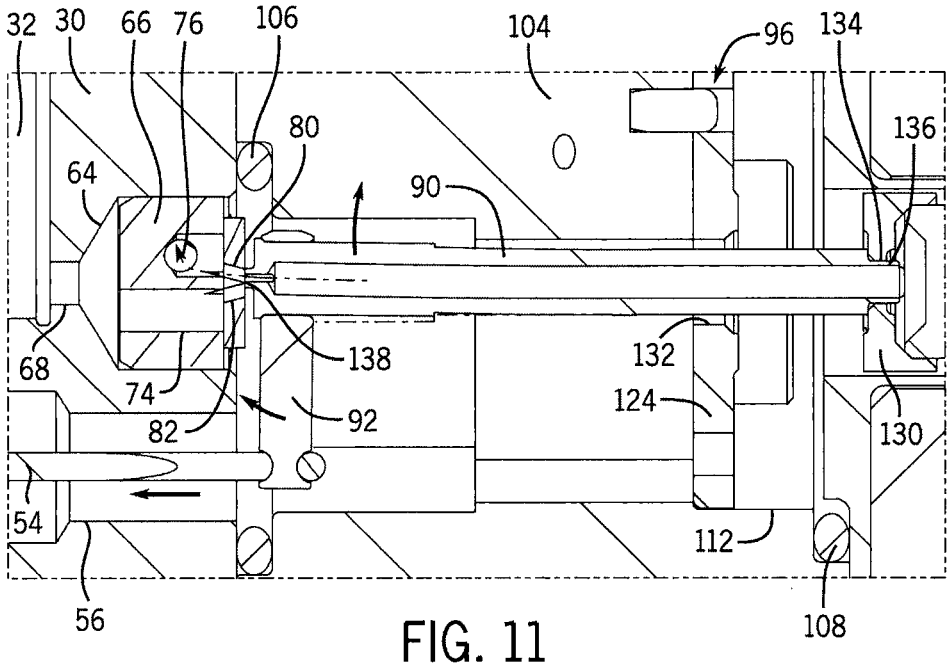
FIG. 11 is a partial enlarged view taken along line 11-11 of FIG. 9 showing the flow path from the jet pipe when retracting the actuator.
Figure 12:
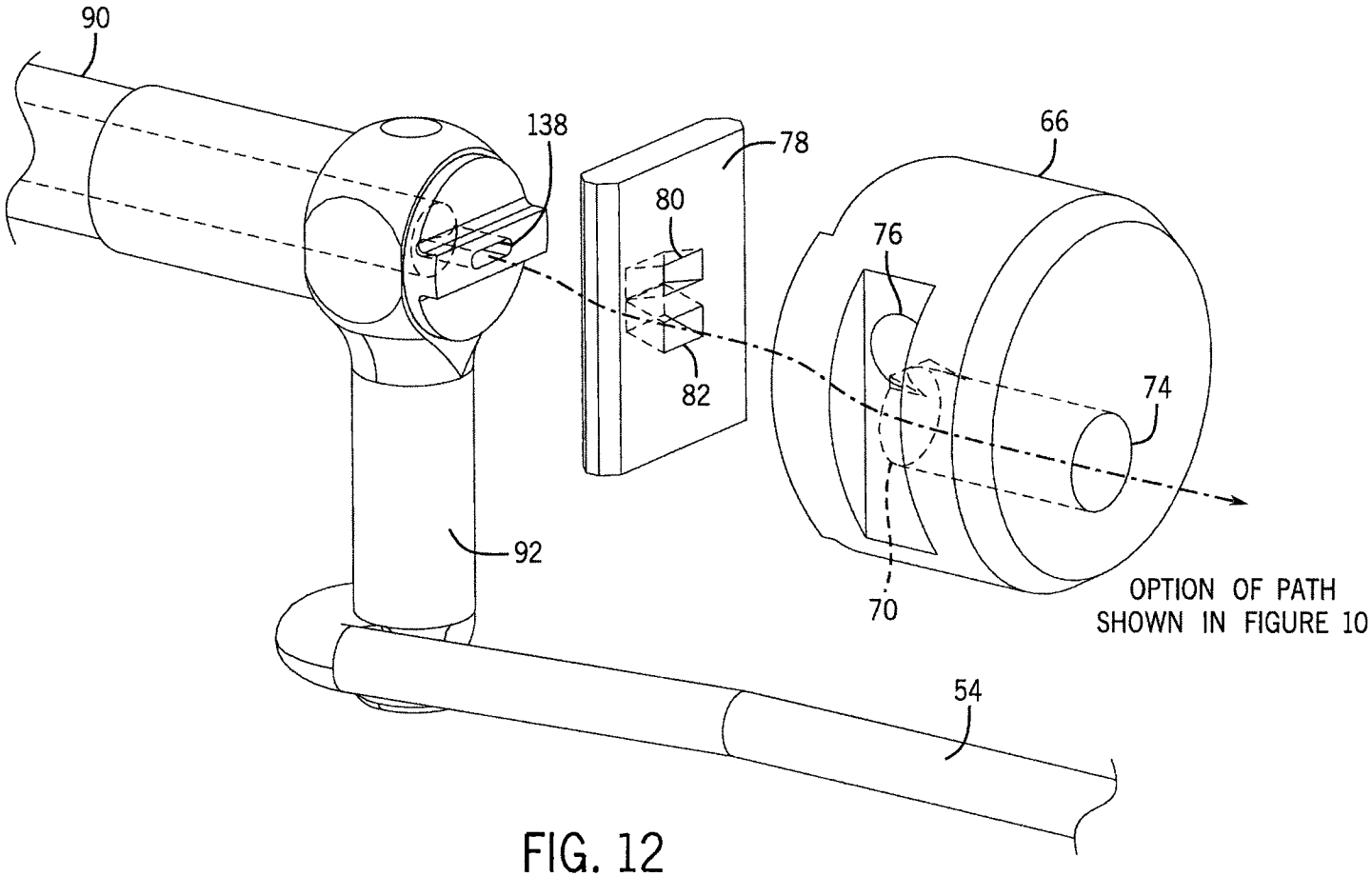
FIG. 12 is a partial enlarged isometric view of the jet receiver components and the flow path shown in FIG. 10.
Figure 13:
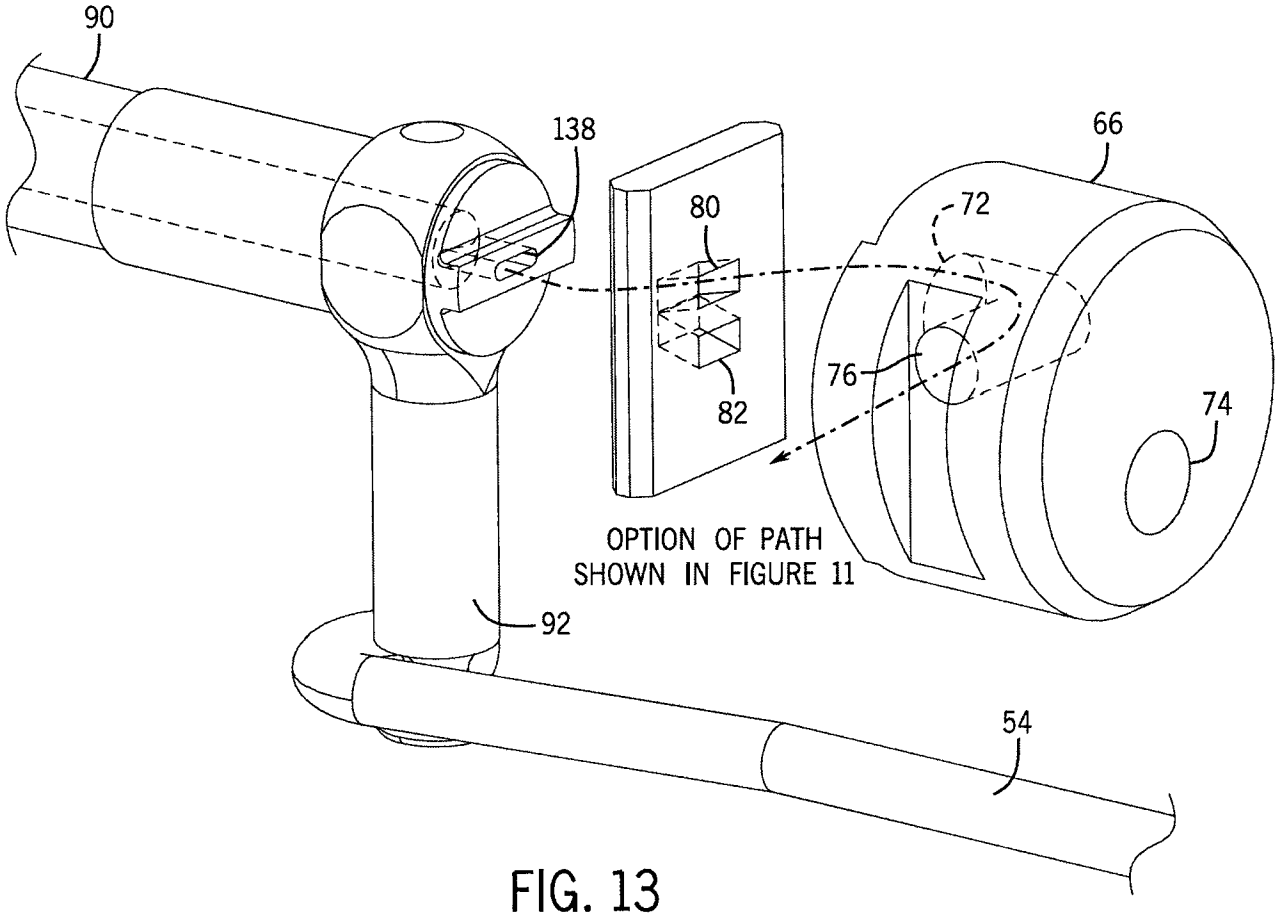
FIG. 13 is a partial enlarged isometric view of the jet receiver components and the flow path shown in FIG. 11.

The disc part 124 of the flexure pivot 96 is bolted to the port block 104 within the recessed cavity 112. The collar part 130 is rigidly connected to the armature 102 of the electromagnet 98, which can be circular in cross-section with a reduced diameter area at the connection to the collar part 130. With the disc part 124 fixed with respect to the coil(s) 100 and the collar part 130 fixed to the armature 102, the struts 128, which are generally rigid, flex slightly upon movement of the armature 102 such that the collar part 130 pivots off axis relative to the disc part 124. Since the end 136 of the jet pipe is fixed to the collar part 130 of the flexure pivot 96 (but not connected to the disc part 124) the jet pipe 90 can also pivot so that the nozzle end 138 moves off axis. As shown in FIG. 10, when the armature 102 is moved in one direction, the nozzle of the jet pipe 90 is made to moved closer to receiver orifice 70, and as shown in FIG. 11, when the armature 102 moves in the opposite direction the jet pipe nozzle is moved closer to receiver orifice 72.

Referring to FIGS. 2 and 6, the armature 102 is connected to the flexure pivot 96 and disposed within a magnetically inert seal tube 140. The seal tube 140 has a flanged end 142 which is mounted to the electromagnet 98 and an annular body 144 that extends into the core of the electromagnet coil(s) 100 to surround the armature 102 and seal off the area of the valve housing 94, via O-ring 108, so as to prevent hydraulic fluid from entering the dry area within the valve housing 94. The seal tube 140 is rigidly fixed with respect to the coil(s) 100 and does not contact any moving parts, neither the driving (e.g., armature) nor the driven (e.g., flexure pivot collar 130 or jet pipe 90) components.

With reference to FIGS. 4 and 6-14, the operation, and hydraulic fluid flow path during operation, of the servo-actuator 20 will now be described in detail. Hydraulic fluid pressure is supplied at inlet port 118 (see FIG. 4) and passed through a filter 150 (see FIG. 15). Hydraulic fluid passes from the inlet port 118 through passages 114 and 116 of the port block 104 and into the flexure pivot 96 through openings 122 in the disc part 124. The hydraulic fluid then passes through passages 126 through the struts 128 and into the collar part 130 where it is redirected by the armature 102 into the jet pipe 90. (see FIG. 6) Hydraulic fluid flows through the jet pipe 90 to the receiver 66. In the absence of energization of the electromagnet 98, the jet pipe nozzle 138 is essentially equidistant from both receiver orifices 70 and 72 (via respective splitter orifices 80 and 82) such that realize equal pressure and no output force differential is present to drive the actuator. Such an state of equilibrium could be exhibited in FIG. 8.

Once electrical input is supplied to the electromagnet 98, the magnetic field generated by the coil(s) 100 causes the armature 102 to move off axis or pivot, as is known, within the seal tube 140. The movement of the armature 102 imparts a force to the collar part 130 of the flexure pivot 96. This in turn causes the struts 128 to flex so that the collar part 130 can pivot with the armature 102. And since it is rigidly connected, the jet pipe 90 also pivots with the collar part 130 and the armature 102. In the retracted position shown in FIG. 7, the electromagnet 98 is driven so that the armature 102 moves to pivot the collar part 130 and the jet pipe 90 as shown in FIG. 10. In this position, the jet pipe nozzle 138 directs hydraulic fluid more toward the receiver orifice 70 such that pressure imbalance occurs that causes fluid to pass through passages 74 and 68 (see FIGS. 10 and 12) and into the cylinder bore 32 through the cylinder port to one side of the piston head so as to drive the piston 34 outward (to the left in FIG. 7). The relatively small input force of the armature 102 will drive the jet pipe 90 which then uses the much greater force of the hydraulic pressure to drive the actuator piston 34. As the actuator piston 34 is extended, the feedback device 46 will impart a counteracting force by virtue of the spring 50 being extended. The feedback force serves several purposes. First, it has a centering effect on the jet pipe 90 such that in the absence of electrical input to the electromagnet 98, it works to return the servo-actuator to a state of equilibrium. It also provides mechanical position feedback that can be sensed and converted to error signals via a suitable transducer (not shown) to drive the electromagnet 98 to reduce or correct inaccuracy. Further, the feedback serves to allow the pressure at the actuator cylinder ports to be proportional to input current to the electromagnet 98. It should be noted that, while not described in the exemplary construction, the force feed back could instead be provided through electronic means, as known in the art.

Figure 9:
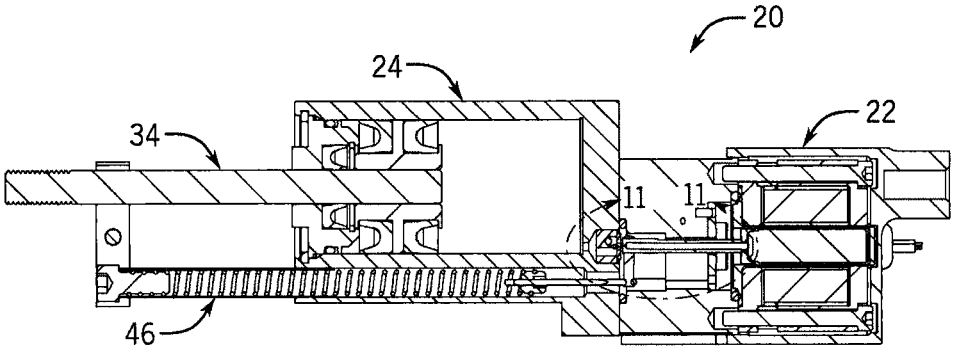
FIG. 9 is a sectional view similar to FIG. 7, showing the servo-actuator in an extended position.

When it is desired to move the actuator in the opposite direction, such as when in the fully extended position shown in FIG. 9, the electromagnet 98 is driven to move the armature 102 in the opposite direction and thereby pivot it, the collar part 130 and the jet pipe 90 so that the jet nozzle 138 directs fluid more toward receiver orifice 72. This creates the opposite pressure imbalance and causes fluid to flow through passages 76, 62, 58 and 60 (see FIGS. 11, 13 and 14) and into the cylinder bore 32 through the cylinder port on the opposite side of the piston head so to drive the piston 34 to retract (to the right in FIG. 9). The same uses of the feedback force are again present.

Accordingly, servomechanisms, such as the exemplary construction described above, exhibit high reliability in high temperature variation, high vibration and high contamination applications. Specifically, the use of the flexure pivot provides improved motion control of the jet pipe by eliminating the need for a jet feed tube and a flexible seal to isolate the coil from the hydraulic fluid. By using a stationary, rigid seal tube the adverse effects of induced vibrations to the driven components are greatly reduced. Also, the associated manufacturing complexity and costs of a jet feed tube and flexible seal are avoided. Moreover, the design also for the use of a circular, non-rectangular armature enhances cost savings in a continuous production manufacturing environment. Finally, performance issues, such as pressure and temperature induced null shifts, are essentially eliminated.

It should be appreciated that the above describes only one construction of the flow control valve. Many modifications and variations to the described construction will be apparent to those skilled in the art, which will be within the spirit and scope of the invention. To ascertain its full scope, the following claims should be referenced.

We claim:

1. A jet pipe servo device, comprising:
- an electromagnet assembly including a coil and an armature;
- a jet pipe having a passageway;
- a flexure pivot having:
  - a first part fixed with respect to the coil;
  - a second part attached to the jet pipe and linked to the armature and movable therewith with respect to the first part;
  - struts joining the first part to the second part; and
  - passages for communicating media passing through the flexure pivot to the passageway of the jet pipe, the passages extending through the struts from the first part to the second part; and
- a jet receiver having first and second orifices, the first orifice receiving media from the jet pipe when the armature is in a first position and the second orifice receiving media from the jet pipe when the armature is in a second position.

2. The device of claim 1, further including a seal tube disposed between the coil and the armature and fixed with respect to the coil, the seal tube sealing the coil from hydraulic fluid.

3. The device of claim 1, wherein opposite ends of the jet pipe are movable with respect to the coil.

4. The device of claim 1, wherein the first part of the flexure pivot includes an opening through which the jet pipe extends and the second part of the flexure pivot includes an opening aligned with the opening in the first part through which the jet pipe extends.

5. The device of claim 4, wherein the jet pipe is aligned with the armature.

6. The device of claim 1, wherein the second part of the flexure pivot is fixed to the armature.

7. The device of claim 1, further including an actuator.

8. The device of claim 7, wherein the actuator includes a cylinder and a piston arrangement and wherein the media from the jet pipe passing through the first orifice actuates the piston and media from the jet pipe passing through the second orifice retracts the piston.

9. The device of claim 7, further including a feedback mechanism linking the piston to the jet pipe.

10. A jet pipe servo device, comprising:
- an electromagnet assembly including a coil and an armature;
- a seal tube receiving the armature and disposed between the coil and the armature fixed with respect to the coil;
- a flexure pivot having a first part fixed with respect to the coil and second part linked to the armature and movable therewith with respect to the first part;
- a jet pipe linked to the second part of the flexure pivot; and
- a jet receiver having first and second orifices, the first orifice receiving media from the jet pipe when the armature is in a first position and the second orifice receiving media from the jet pipe when the armature is in a second position;
- wherein the first and second parts of the flexure pivot are joined by struts defining passages for communicating media passing through the first and second parts to a passageway of the jet pipe.

11. The device of claim 10, wherein opposite ends of the jet pipe are movable with respect to the coil.

12. The device of claim 10, further including a feedback mechanism linked to the jet pipe.

13. A jet pipe servo device, comprising:
- a servo valve, including:
  - an electromagnet;
  - a flexure pivot having:
    - first and second parts movable with respect to one another, the first part having one or more first openings therethrough;
    - struts joining the first part to the second part; and
    - passages for communicating media through the flexure pivot, the passages extending through the struts from at least one of the first openings of the first part to the second part;
  - a jet pipe fixed to the second part of the flexure pivot and movable with respect to the first part of the flexure pivot; and
  - a jet receiver having first and second orifices, the first orifice receiving media from the jet pipe when the armature is in a first position and the second orifice receiving media from the jet pipe when the armature is in a second position; and
  - an actuator, including:
    - a cylinder and a piston arrangement and wherein the media from the jet pipe passing through the first orifice actuates the piston and media from the jet pipe passing through the second orifice retracts the piston.

14. The device of claim 13, wherein opposite ends of the jet pipe are movable with respect to the first part of the flexure pivot.

15. The device of claim 13, wherein the electromagnet includes a coil and an armature, and further including a seal tube disposed between the coil and the armature and fixed with respect to the coil, the seal tube sealing the coil from hydraulic fluid.

16. The device of claim 15, wherein the first part of the flexure pivot is fixed with respect to the coil and the second part of the flexure pivot is fixed to the armature.

17. The device of claim 13, wherein the first part of the flexure pivot includes a second opening through which the jet pipe extends, the second opening providing clearance between the second opening and the jet pipe.

18. The device of claim 17, wherein the second part of the flexure pivot includes an opening aligned with the second opening in the first part, and wherein a reduced diameter end of the jet pipe is rigidly connected to the second part of the flexure pivot at the opening of the second part.

* * * * *